US005088360A

United States Patent [19]

Lish

[11] Patent Number: 5,088,360

[45] Date of Patent: Feb. 18, 1992

[54] UNIVERSAL LOCK-ON WRENCH

[76] Inventor: Dennis N. Lish, 2501 Greenbrier La., La Habra, Calif. 90631

[21] Appl. No.: 607,722

[22] Filed: Nov. 1, 1990

[51] Int. Cl.[5] ..... B25B 13/06

[52] U.S. Cl. ..... 81/180.1; 81/185.2; 81/124.4; 81/124.7; 81/DIG. 1

[58] Field of Search ..... 81/180.1, 184, 185.2, 81/124.4, 124.7, 125.1, DIG. 1, 121.1, 462, 119

[56] References Cited

U.S. PATENT DOCUMENTS 184,775 11/1876 Gray ..... 81/124.4 X 4,305,438 12/1981 Spinosa et al. ..... 81/125.1 X

FOREIGN PATENT DOCUMENTS 728789 7/1932 France ..... 81/124.4

26040 of 1898 United Kingdom ..... 81/119

*Primary Examiner*—D. S. Meislin

*Attorney, Agent, or Firm*—Edgar W. Averill, Jr.

[57] ABSTRACT

A replacement wrench is provided which has a body formed into a right angle wherein one leg has an elongated socket and the other leg has a somewhat symmetrical socket disposed near one end and has an elongated slot with a slideable stop therein and capable of being locked into any position along the slot.

3 Claims, 1 Drawing Sheet

UNIVERSAL LOCK-ON WRENCH

BACKGROUND OF THE INVENTION

1. Field of the Invention

This invention relates to a tool of the type used to open and close underground valves for use in fire protection sprinkler systems and each having a indicator post extending upward above ground and, more particularly, to a tool of the wrench type which is universal so that it can be locked onto indicator posts of different designs.

2. Description of the Prior Art

Up to now one finds that lock-on wrenches for indicator posts were designed to be locked-on only one make or type of indicator posts even though the exposed head for the extension rod that is coupled to the underground valve is of universal design, i.e., square. The reasons that the prior art wrenches were not universal is because the posts happens to have different diameters and because the posts had to have a locking staple which happened to be placed at a different vertical locations on the various posts.

SUMMARY OF THE INVENTION

1. Statement

I have discovered that the locking staples were located at different vertical positions and the diameters of the different indicator posts were not uniform. Although the head thereon is centrally located, I have found that horizontal spacing between the head and the locking stable on the different posts are not equal. Therefore my novel wrench to operate the valve is formed having a 90 degree bend with an elongated socket or belong hole formed on the short leg and another socket or square hole formed near the end of the longer leg. This allows one to use the socket or square hole on the longer leg to obtain leverage to turn the head of the valve while the oblong hole on the shorter leg is used to secure the wrench. The elongated hole compensates for the different diameters, as above mentioned. The securing is done by engaging the head into the oblong hole on the shorter leg so that the longer leg depends alongside of the post. Each prior art wrench had a slot which accommodated the locking staple whereby a padlock could be used to secure the wrench. However, my wrench required an elongated slot to accommodate the different staple position. To insure that the head could not become disengaged from the oblong hole on the shorter leg after my wrench is secured, the elongated slot is provided with a slidable stop within the elongated slot which stop can be locked at any place along the slot. Then by placing and locking the stop at a place just below the staple and remote from the head, one cannot disengage the head from the wrench unless the padlock is removed or the locking means broken.

2. Objects

An object of this invention is to provide a wrench that is capable of being locked-on many different indicator posts for an underground valve.

Another object of this invention is to provide, in a wrench with a 90 degree bend, with a oblong hole formed in its short leg and with a square hole formed in its long leg and near one end, an oversize elongated slot also formed in its long leg and a slidable and lockable stop disposed within the slot.

DETAILED DESCRIPTION OF THE DRAWING

Figure 1:
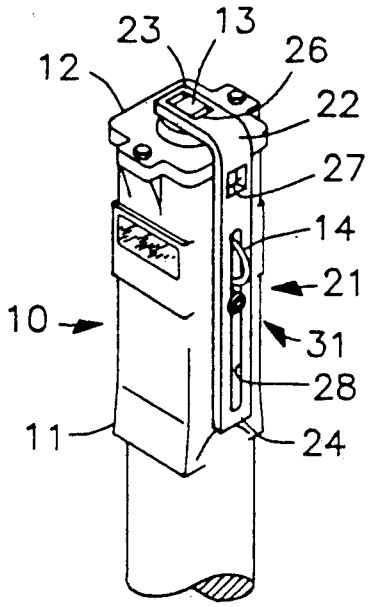
FIG. 1 a pictorial view of a typical indicator post with my novel wrench thereon in the locking position.

Referring to the drawing and to FIG. 1, in particular, the item 10 schematically depicts one of the commerically available indicator posts. One of the posts would have a tubular body 11, a cover 12 at it top end and a square head 13 protruding upward through the cover 12. To refresh ones memory, the square head 13 is formed on the end of an enclosed rod (not shown) and is rotatable within the cover 12 so that the rod can be rotated by rotating the head thereby, in turn, opening or closing the valve. On the side of the tubular body 11 one finds a locking staple 14 suitably mounted.

My novel wrench 21 is shown stored on the post 10. The wrench 21 is conveniently made of (for example) metallic bar stock that is bent at a 90 degree angle, forming a right angle 22, a short leg 23 and a long leg 24. The short leg 23 has formed therein an oblong hole 26 oriented parallel to the stock, for reasons that will become apparent hereinafter, and conveniently located from the right angle 22, also as will become apparent hereinafter. The long leg 24 has square hole 27 which is congruent to the head 13, for obvious reasons, and which is located near one end of the long leg 24 and in this embodiment near the right angle 22. This hole 27 could also be placed at the other end of the long leg 24 without departing from the spirit of my invention. The long leg 24 also has formed therein an overly elongated slot 28 that extends almost the length of the long leg 24. Through the overly elongated slot 28, the locking staple 14 can be threaded and, through the oblong hole 26, the square head 13 can be threaded. One can see that because of the oblong hole 26 the long leg 24 would depend along side o the tubular body 11 to be able to engage the locking staple 14. Through the locking staple 14 one can place the link of a padlock (not shown) whereby the long leg 24 is restrained in its horizontal movement but is not restrained in its vertical movement. As mentioned before, since the long leg 24 and, in turn, the wrench 21 can move upward, the square head 13 can be removed out of oblong hole 26 whereby unauthorized operation of the valve (not shown) can happen.

Figure 3:
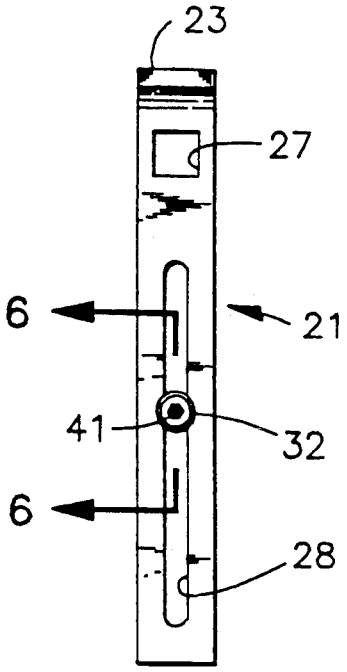
FIG. 3 is an elevation of my wrench showing the back side or the side as viewed from the left in FIG. 2.
Figure 4:
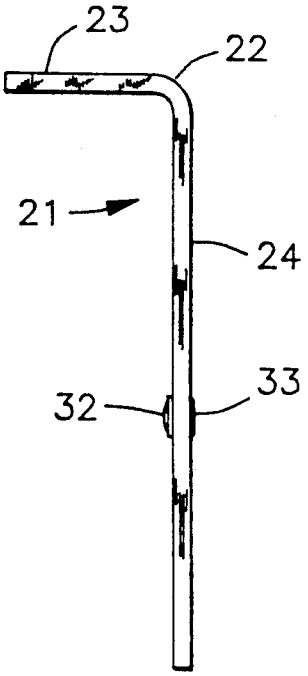
FIG. 4 is an elevation side view of my wrench as viewed g from the right in FIG. 2.
Figure 2:
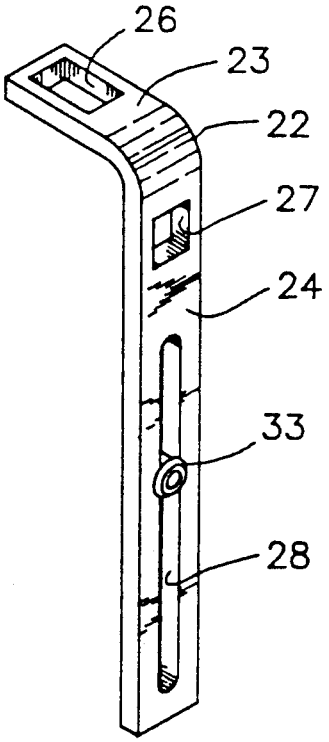
FIG. 2 an enlarged pictorial view of my wrench which is shown in FIG. 1 and which is removed from the indicator post.
Figure 5:
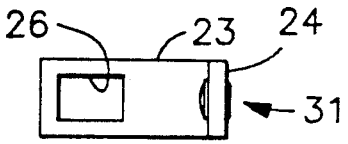
FIG. 5 is a bottom view of my wrench as viewed upwards in FIG. 2.
Figure 6:
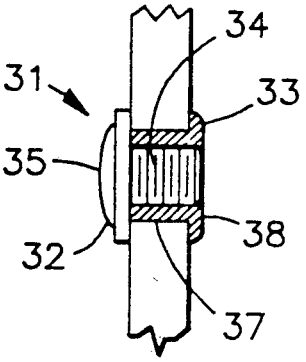
FIG. 6 is a partial section taken on line 6—6 in FIG. 3 and in the direction of the arrows.

I have found that, by placing a suitable stop 31 within the overly elongated slot 28, I could prevent the wrench from being able to be lifted upward. Referring to FIG. 6 in particular, the stop 31 is shown enlarged and in cross-section. As mentioned above, to be useful the stop 31 should be able to slide within the slot 28 and should be able to be locked at any position therealong. To accomplish this result, I have made the stop 31 into two pieces, a male piece 32 and a female piece 33. The male piece 32 has a threaded shank 34 attached to a head 35 while the female piece 33 is what is commonly called a flange nut and has an internally threaded sleeve 37 attached to another head 38 which being a flange nut has a square cross-sectional shaft near its head 38. This square cross-section as everyone knows nests within the slot 28 and therefore cannot be rotated. The threaded shank 34 is threaded into sleeve 37, as shown. In order for the heads 35 and 38 to be able bear against the long leg 24, I have made the length of sleeve 37 less than the thichness of the long leg 24 (as shown in FIG. 6) and I have formed an irregular shape recess or a suitable turning socket 41 in head 35 more clearly shown in FIG. 3. As shown, since the male piece 32 has the socket 41, it is placed on the inside of the right angle 22 so that when the wrench 21 is secured onto the post one would find it relatively difficult to place a suitable tool (not shown) into the socket 41 to turn it.

OPERATION

To make use of the new feature of my novel wrench 21, it is operated as follows: After one obtains my wrench because the one that came with the post 10 was misplaced, the wrench is placed on the post in the position as shown in FIG. 1. More than likely the stop is not positioned correctly. Therefore, one marks the wrench with a suitable marker (not shown) so that a mark is placed on the wrench just below the staple 14. The wrench is removed and the stop 31 is loosened by using a suitable tool (not shown) to turn the inner piece which in this embodiment happens to be the male piece 32. The loosened stop is moved to where the mark is located and secured in place. The wrench is again placed on the post in the manner as already described. If the staple 14 cannot be inserted within the slot 28 because the stop 31 is in the way, one simply repeats the above procedure to move the stop out of the way. If the staple 14 can be nested within the slot 28, one must make a test to see if the wrench can be moved without being unlocked. This is done by lifting the wrench vertically while the staple is within the slot and trying to see if the wrench can be lifted sufficiently whereby the head 13 becomes disengaged from the hole 26. One can obviously now see after reading this application the stop 31 should be moved closer to the staple 14 by repeating the above procedure. I have found that the stop 31 can be at least one-quarter inch from the staple and still my wrench cannot be removed by unauthorized persons after a suitable padlock is linked into the staple 14, in a manner that is standard in the art.

I claim:

1. In a wrench of the type having an elongated body which is formed into a right angle forming a short leg and a long leg, said short leg having a first socket formed therein and said on leg having a second socket formed therein and disposed near one end thereof; the improvement comprising:

said long leg having an overly elongated slot having opposing ends each of which are spaced from said second socket and from the other end of said long leg thereof respectively;

a slidable stop disposed within said slot; and means are provided to secure said stop in a respective place along said slot.

2. In the wrench of claim 1 wherein said means comprises:

a male piece having external threads, a female piece having internal threads wherein said male piece is capable of being threaded into said female piece, a head disposed on each of said male and female pieces, one of said heads having an irregular shaped recess formed therein, said piece having said irregular shaped recess is disposed so that its head is located on the side of said long leg adjacent said short leg.

3. In the wrench of claim 2 wherein said irregular shaped recess is located on said male piece.

* * * * *